US006173950B1

(12) United States Patent
Bakoledis

(10) Patent No.: US 6,173,950 B1
(45) Date of Patent: Jan. 16, 2001

(54) SHEET FEEDING MECHANISM

(75) Inventor: Andrew Bakoledis, Chester, CT (US)

(73) Assignee: GBR Systems Corporation, Chester, CT (US)

( * ) Notice: Under 35 U.S.C. 154(b), the term of this patent shall be extended for 0 days.

(21) Appl. No.: 09/307,484

(22) Filed: May 10, 1999

(51) Int. Cl.[7] ..... B65H 3/04

(52) U.S. Cl. ..... 271/34; 271/110; 271/149; 271/152

(58) Field of Search ..... 271/34, 110, 149, 271/151, 152, 155, 4.06

(56) References Cited

U.S. PATENT DOCUMENTS

| | | | | |
|---|---|---|---|---|
| Re. 34,894 | * | 4/1995 | Golicz et al. | 271/6 X |
| 622,106 | | 3/1899 | Berry . | |
| 1,112,816 | | 9/1914 | Manchester . | |
| 1,207,365 | | 12/1916 | Broadmeyer . | |
| 1,976,788 | | 10/1934 | Kurth . | |
| 2,138,306 | | 11/1938 | Patrick . | |
| 2,291,010 | | 7/1942 | Vergobbi . | |
| 2,324,930 | | 7/1943 | Joa . | |
| 2,715,975 | | 8/1955 | Doane et al. . | |
| 2,903,133 | | 9/1959 | Quinn et al. . | |
| 2,936,087 | | 5/1960 | Glazer . | |
| 2,969,235 | | 1/1961 | Billet et al. . | |
| 2,992,820 | | 7/1961 | Tarbuck et al. . | |
| 3,025,051 | | 3/1962 | David et al. . | |
| 3,045,846 | | 7/1962 | Clark . | |
| 3,108,801 | | 10/1963 | Van Dalen . | |
| 3,125,337 | | 3/1964 | Cruzen . | |
| 3,194,549 | | 7/1965 | Wirtz . | |
| 3,226,109 | | 12/1965 | Thompson . | |
| 3,347,348 | | 10/1967 | Flint et al. . | |
| 3,486,819 | | 12/1969 | Di Giulio . | |
| 3,527,456 | | 9/1970 | Swartz . | |
| 3,575,410 | | 9/1968 | Suzuki . | |
| 3,635,463 | | 1/1972 | Stobb . | |
| 3,683,758 | | 8/1972 | Feldkamper . | |
| 3,741,413 | | 6/1973 | Friel . | |
| 3,825,248 | | 7/1974 | Friend . | |
| 3,894,732 | | 7/1975 | Muller . | |
| 3,927,876 | | 12/1975 | Wojtowicz et al. . | |
| 3,944,215 | | 3/1976 | Fallos et al. . | |
| 3,981,493 | | 9/1976 | Klappenecker et al. . | |
| 3,982,749 | * | 9/1976 | Stubb | 271/4 X |
| 3,988,017 | | 10/1976 | Kyhl . | |
| 4,025,068 | | 5/1977 | Collins . | |
| 4,077,620 | | 3/1978 | Frank et al. . | |
| 4,128,236 | | 12/1978 | Lundblad . | |
| 4,171,130 | | 10/1979 | Jeschke et al. . | |
| 4,177,982 | | 12/1979 | Bewersdorf et al. . | |
| 4,302,000 | | 11/1981 | Frank . | |
| 4,376,530 | | 3/1983 | Akai . | |
| 4,397,455 | | 8/1983 | Hickey . | |
| 4,500,084 | | 2/1985 | McInery . | |
| 4,523,753 | | 6/1985 | Hiromori et al. . | |
| 4,566,685 | * | 1/1986 | Irvine et al. | 271/150 X |
| 4,697,973 | * | 10/1987 | Hahn et al. | 414/330 X |
| 4,715,593 | | 12/1987 | Godlewski . | |
| 4,744,555 | | 5/1988 | Naramore et al. . | |

(List continued on next page.)

*Primary Examiner*—Christopher P. Ellis
*Assistant Examiner*—Kenneth W Bower
(74) *Attorney, Agent, or Firm*—Joseph J. Previto

(57) ABSTRACT

A sheet feeding mechanism comprising a feed belt assembly, a conveyor for feeding sheets to the feed belt assembly, the feed belt assembly having a belt driven first by a first drive roller, an idler roller assembly having an idler roller spaced from the first drive roller and driven by the first drive roller and a feed switch. The idler roller is mounted for pivotal movement toward and away from the feed switch whereby the feed switch mechanism will be activated by the idler roller assembly to permit sheets to be fed. The feed belt assembly comprises a take-up belt assembly and a delivery belt assembly and said conveyor moves sheets against the take-up assembly.

25 Claims, 6 Drawing Sheets

U.S. PATENT DOCUMENTS

| | | | | |
|---|---|---|---|---|
| 4,871,162 | | 10/1989 | Imai et al. . | |
| 4,928,944 | | 5/1990 | Golicz . | |
| 4,955,596 | * | 9/1990 | Ricciardi | 271/110 X |
| 5,094,574 | * | 3/1992 | Braen et al. | 271/2 X |
| 5,249,788 | | 10/1993 | Helmstadter . | |
| 5,372,360 | | 12/1994 | Ricciardi . | |
| 5,842,694 | * | 12/1998 | Brooks et al. | 271/38 X |

* cited by examiner

SHEET FEEDING MECHANISM

BACKGROUND

The present invention relates to feeding mechanisms and more particularly to feeding mechanisms for feeding sheets of paper from a source to a receiving area at a remote location.

In present high speed mechanisms for printing and handling sheets of paper, the sheets are fed one-by-one at very high speeds from a stack or some other source to a remote area at a remote location, such as an accumulating area. It is also important that the sheets be fed in shingle fashion in order to obtain the maximum feeding speeds required by present high speed printing, feeding, folding and mailing systems.

OBJECTS

One object of the present invention is the provision of an improved sheet feeding mechanism which can feed and deliver single sheets quickly into a remote receiving area from a source in order to permit multiple sheet stacking and/or delivery of such sheets at very high speeds.

Another object of the present invention is the provision of an improved sheetfeeding mechanism in which the source or a similar mechanism can feed and delivery sheets from a vertical stack or horizontal stack.

Another object of the present invention is the provision of an improved sheet feeding mechanism in which the same or similar mechanism can be used to deliver sheets to different types of destinations.

Another object of the present invention is the provision of an improved sheet feeding mechanism in which the same or similar feed mechanism may be used to feed from different sources.

Another object of the present invention is the provision of an improved sheet feeding mechanism which is simple and inexpensive to operate and maintain.

Other and further objects will be obvious upon the understanding of the illustrative embodiment about to be described, or which will be indicated in the appended claims, and various advantages not referred to herein will occur to one skilled in the art upon employment of the invention in practice.

In order to accomplish these objects, the present invention provides an improved system of belts and rollers which control and feed the sheets accurately from a source to a remote receiving area. In general, a stack is moved against a feed assembly which separates the individual sheets from the stack and transfers the sheets to a remote destination. As each sheet is separated and removed from the stack, a spring-pressed mechanism maintains the feed assembly in constant contact with the subsequent sheets in the stack so that the sheets are removed from the stack and fed to the remote destination in shingle fashion. When a predetermined number of sheets are removed from the stack, the spring-pressed mechanism comes in contact with a demand switch which commands that additional sheets be delivered to the stack.

DRAWINGS

A preferred embodiment of the invention has been chosen for purposes of illustration and description and is shown in the accompanying drawings forming a part of the specification wherein.

DESCRIPTION

Figure 1:
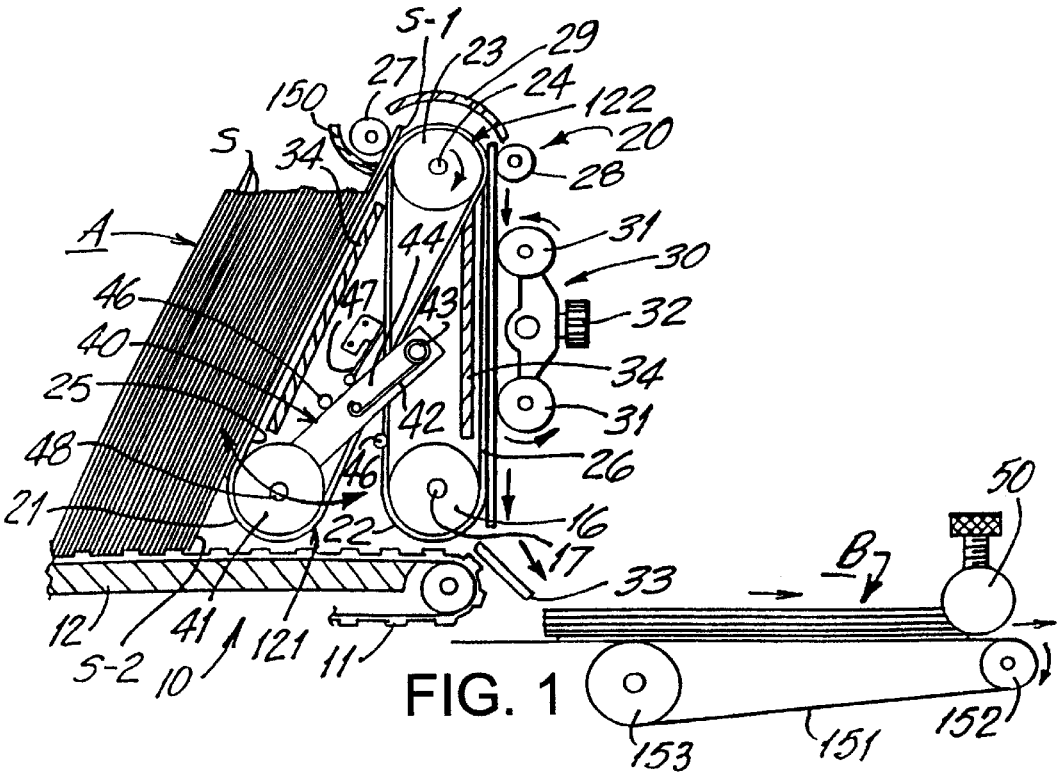
FIG. 1 is a simplified, diagrammatic side view of the feed mechanism of the present invention.
Figure 3:
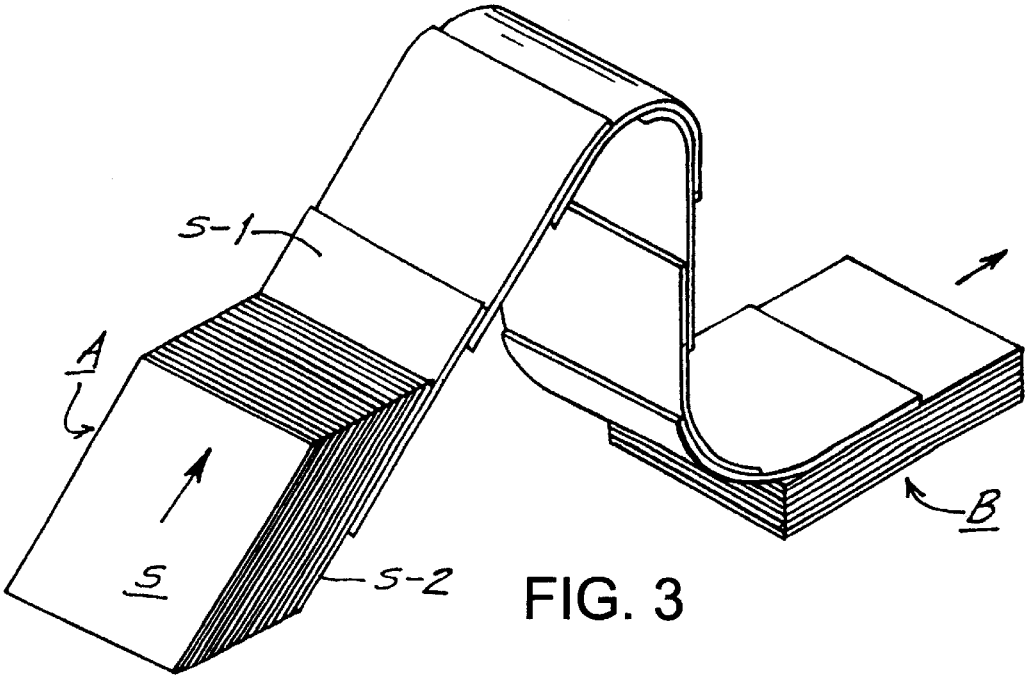
FIG. 3 is a simplified, diagrammatic, perspective view showing the path of the sheets which are fed from one stack to another location in shingle fashion in the embodiment of FIG. 1.
Figure 2:
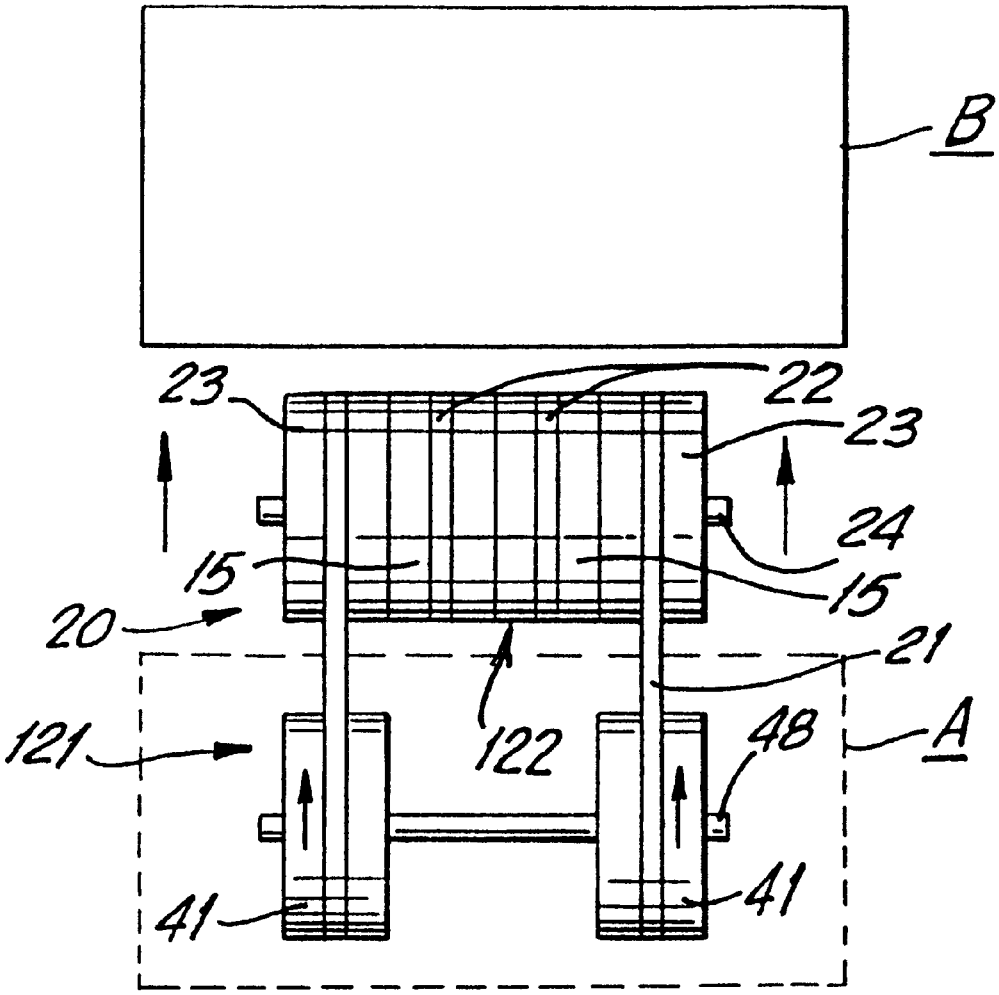
FIG. 2 is a simplified, diagrammatic top view of the embodiment shown in FIG. 1 with a stack of sheets being shown in broken lines.

Referring to the drawings and more particularly to the embodiment shown in FIGS. 1 to 3, sheets S are fed one-by-one from a vertically oriented stack A onto a horizontally oriented accumulation area B which in this embodiment is shown as being located at a level substantially at or below the level of a vertical stack A from which the sheets S are fed. The sheets S are arranged in the vertical stack A on a feed belt assembly 10 having a dead plate 12 and a horizontal belt 11 which moves the vertical stack A forward until it strikes and rests on a feed belt assembly 20. The feed belt assembly 20 comprises a take-up belt assembly 121, a plurality of take-up belts 21 and delivery belt assembly 122 having a plurality of delivery belts 22. The stack A rests on the take-up belt 21 of the take-up belt assembly 121. In FIG. 2, the stack A resting on the take-up belts 21 is shown in broken lines for clarity. A dead plate 34 is provided along the inner surface of the outer run 25 of the take-up belts 21 in order to support the stack of sheets A as it is being moved against the take-up belts 21. The take-up belts 21 are driven by drive rollers 23 which are rotated by a drive shaft 24. The take-up belts 21 also rotate idler rollers 41 which will be described in greater detail hereinbelow. The delivery belts 22 are at an angle to the take-up belts 21 and are driven by a drive roller 15 which are rotated by the drive shaft 24 which is the same drive shaft which rotates the drive rollers 23 which drive the take-up belts 21. The delivery belts 22 also rotate lower idler rollers 16 mounted on shaft 17. The outer runs 25 of the take-up belts 21 move upwardly toward driver rollers 23 and the outer runs 26 of the delivery belts 22 move downwardly. A curved guide 150 above the stack S controls the number of sheets that are allowed to pass between belt 21 and guide 29 at any one time and guarantees shingling even if there is static build-up between the sheets. With this structure, sheets S are removed from the vertical stack S one-by-one by the take-up belts 21. They are moved up by the take-up belts 21 and are then transferred to the delivery belts 22. They are moved down by the delivery belts 22 and deposited onto an accumulating area B which is shown as being horizontally oriented and having an adjustable stop 50. The accummulating area B is on a movable belt 151 driven by drive roller 152 over idler roller 153. The adjustable strap 150 has its height adjusted to allow a single sheet at a time to be removed from the bottom of the stack in the accumulating area B by the belt 151.

Pinch rollers 27–28 are provided to direct each sheet S from the take-up belts 21 to the delivery belts 22. A curved deflector plate 29 is mounted between the pinch rollers 27–28 in order to guide each sheet S as it moves from the take-up belts 21 to the delivery belts 22. A pressure roller assembly 30 having spaced rollers 31 and pressure adjusting knob 32 is mounted adjacent to the outer surface of the outer runs 26 of delivery belts 22 in order to press each sheet S firmly against the delivery belts 22. Another dead plate 34 is mounted along the inner surface of the outer run 26 of the delivery belts 22 and cooperates with the pressure roller assembly 30 to permit each sheet S to be positively directed by the delivery belts 22 into the accumulation area B. A lower guide 33 may also be provided to direct each sheet S into the accumulation area B.

A spring-pressed pulley arm assembly 40 (not shown in FIG. 2 for clarity) is mounted with the take-up belt assembly 121 and comprises the lower idler rollers 41 mounted on a shaft 48 on which is mounted a tiltable arm 44 extending outwardly from shaft 48 and which pivots on a pin 43. The lower idler rollers 41 are pressed against the inner surface of the outer runs 25 of the take-up belts 21 by a torsion spring 42 mounted on pin 43 which keeps the idler rollers 41 and the lower part of the take-up belts 21 pressed against the lower part of the stack A. When the first sheet S-I (i.e. the sheet resting on the take-up belts 21) is being removed from the stack A by the take-up belts 21 as soon as said first sheet S-1 is clear of the idler rollers 41, the spring-pressed arm pulley assembly 40 will move tile idler rollers 41 and lower parts of the take-up belts 21 against the rear (lower) end of the next sheet S-2 in the stack A. This starts the feeding of the next sheet S-2 by the take-up belts 21 before the first sheet S-1 is clear of the front upper part of the stack and the take-up belts 21 so that the first sheet S-1 and the next sheet S-2 are fed in superimposed or shingling relationship to each other. This process is repeated and continued with each sheet S in the stack A and is shown diagrammatically in FIG. 3 where it will be noted that the individual sheets S are being removed from the vertical stack A and deposited on the horizontal stack B in superimposed or shingle fashion in a substantially continuous path.

Stops 45–46 are provided adjacent arm 44 to limit the movement of the arm 44 and its lower idler rollers 41 in either direction. A limit switch 47 is also provided adjacent the arm 44 so that when the arm 44 reaches a certain point toward the vertical stack A, the limit switch 47 will be activated and the mechanism is commanded by any well-known means (not shown) to demand more paper and/or to advance the vertical stack A towards and against the support plate 34 always keeping the stack biasing the feed belt 21 and the plate 34.

Figure 5:
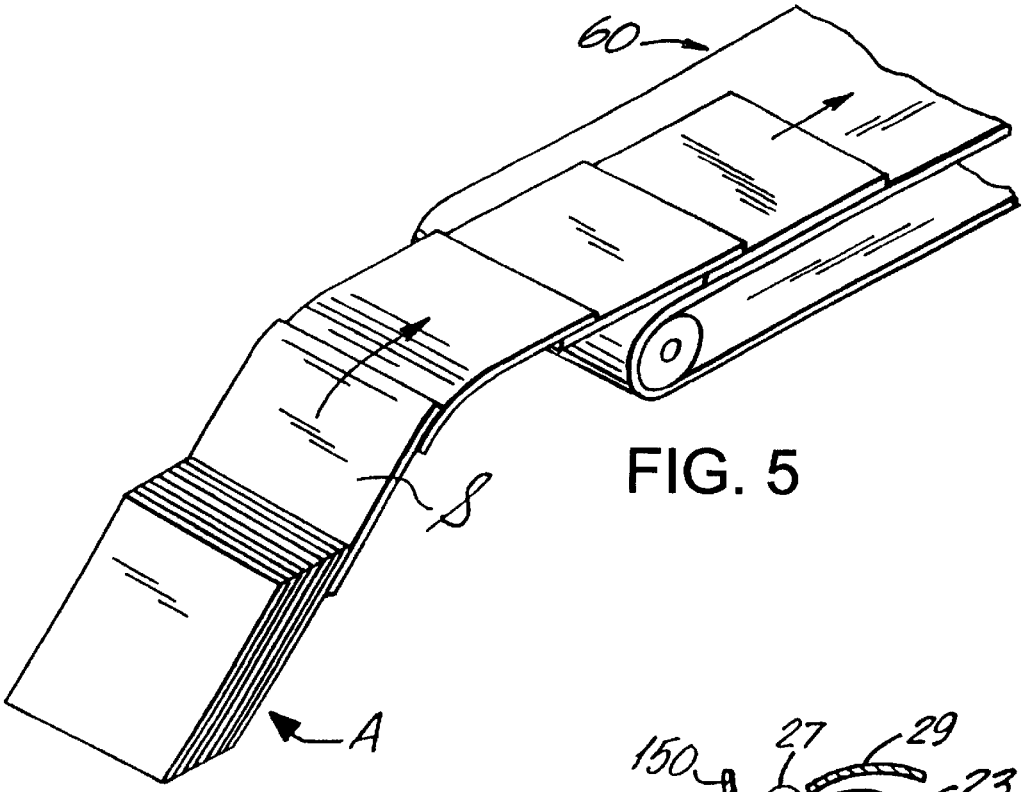
FIG. 5 is a simplified, diagrammatic perspective view showing the path of the sheets being fed in shingle fashion in the embodiment shown in FIG. 4.
Figure 4:
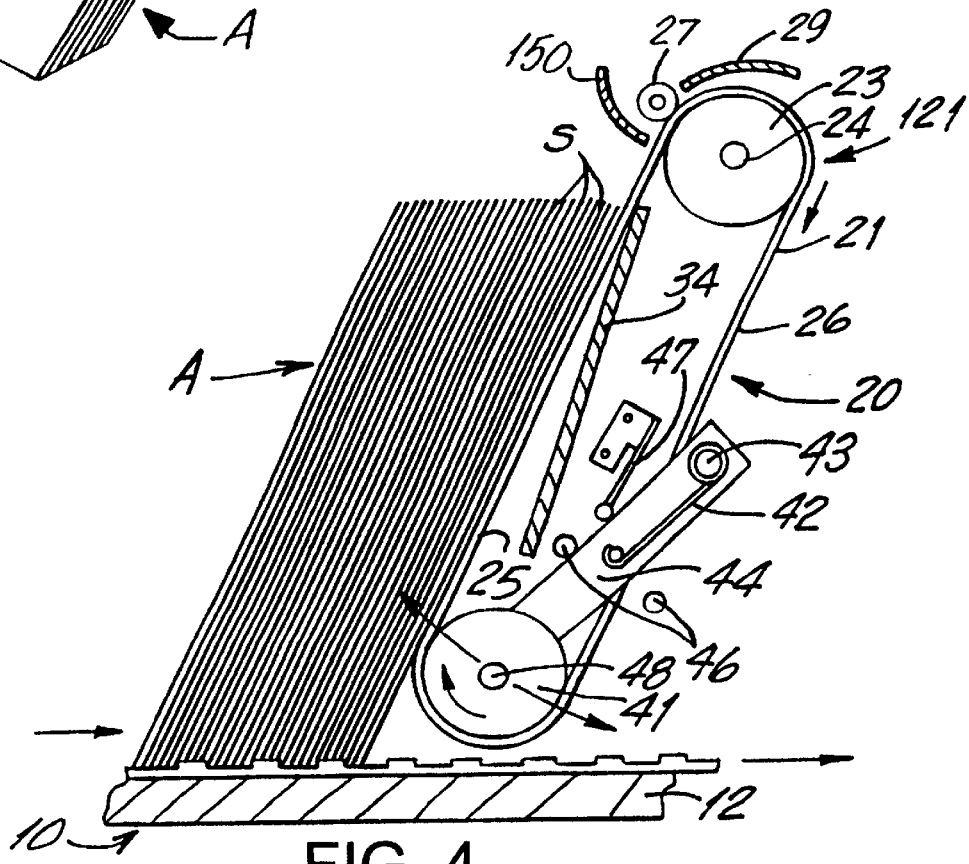
FIG. 4 is a simplified, diagrammatic, side view of another embodiment of the present invention.

Referring now to the embodiment of the invention shown in FIGS. 4 and 5, the sheets S are fed in shingle fashion to a conveyer assembly 60 which is above the level of the vertical stack A and which is adapted to move the sheets S to another location (not shown). The take-up assembly 121 used in this embodiment may preferably be the same as the take-up assembly 121 shown in the embodiment of FIGS. 1–3. The same reference characters are used to identify the various structural elements in this FIGS. 4–5 embodiment that were used to identify the same structural elements in the FIGS. 1–3 embodiment. However, it will be noted that in this embodiment, it is not necessary to use the delivery assembly 122 of the FIGS. 1–3 embodiment since the take-up assembly 121 will feed sheets S directly to the conveyer assembly 60 without the need of the delivery assembly 122. The path of the sheets S in shingle fashion from the vertical stack A to the conveyor assembly 60 in this embodiment is shown diagrammatically in FIG. 5.

Figure 6:
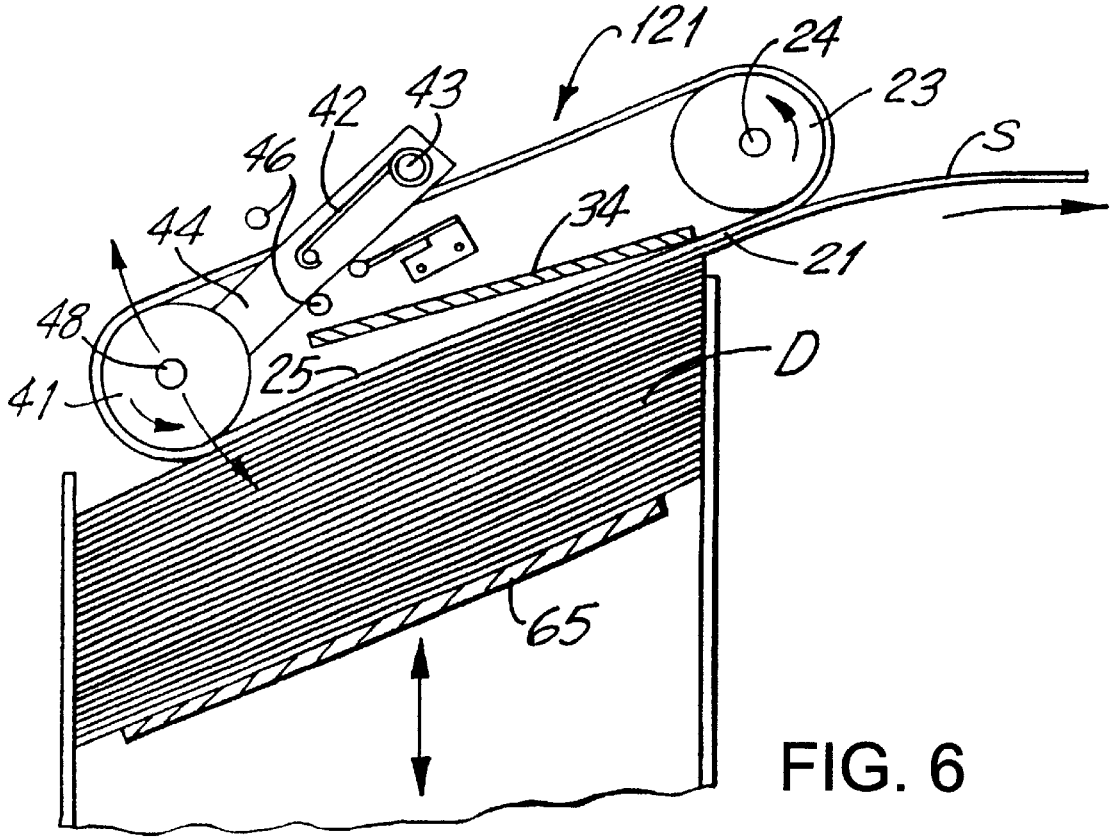
FIG. 6 is a simplified, diagrammatic, side view of another modification of the present invention.
Figure 7:
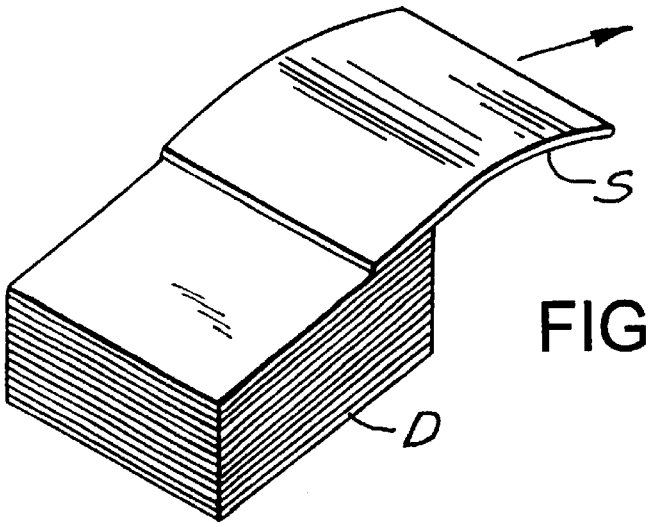
FIG. 7 is a simplified, diagrammatic perspective view showing the path of the sheets being fed shingle fashion in the embodiment shown in FIG. 6.

Referring to the embodiment of the invention shown in FIGS. 6 and 7, the stack D from which the sheets S are fed is a horizontal stack. Take-up assembly 121 is also horizontally oriented and lies over the top of the horizontal stack D. A lower elevation mechanism 65 moves the stack D up against the take-up belts 21 which feeds the sheets S one by one in shingle fashion to a remote receiving area (not shown). The take-up assembly 121 used in this embodiment is the same as the take-up assembly 121 shown in the embodiment of FIGS. 1 and 2 and the same reference characters will be used to identify the same structural elements in both. Here again, it will be noted that the delivery assembly 122 of the FIGS. 1–3 embodiment is not needed and has not been shown. The sheets S are fed one by one in shingle fashion in a path shown diagrammatically in FIG. 7.

Figure 8:
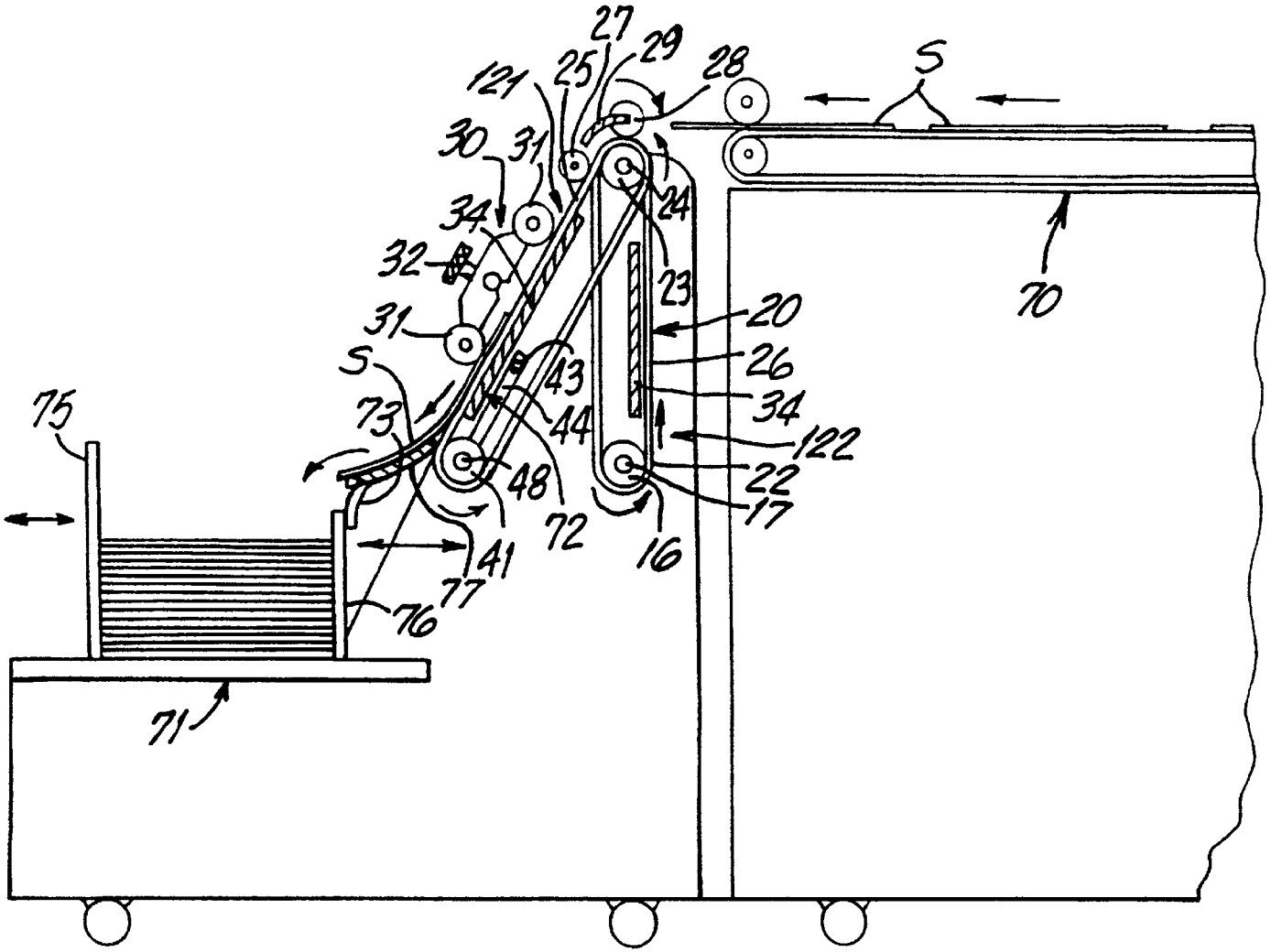
FIG. 8 is a simplified, diagrammatic side view of still another embodiment of the present invention.
Figure 9:
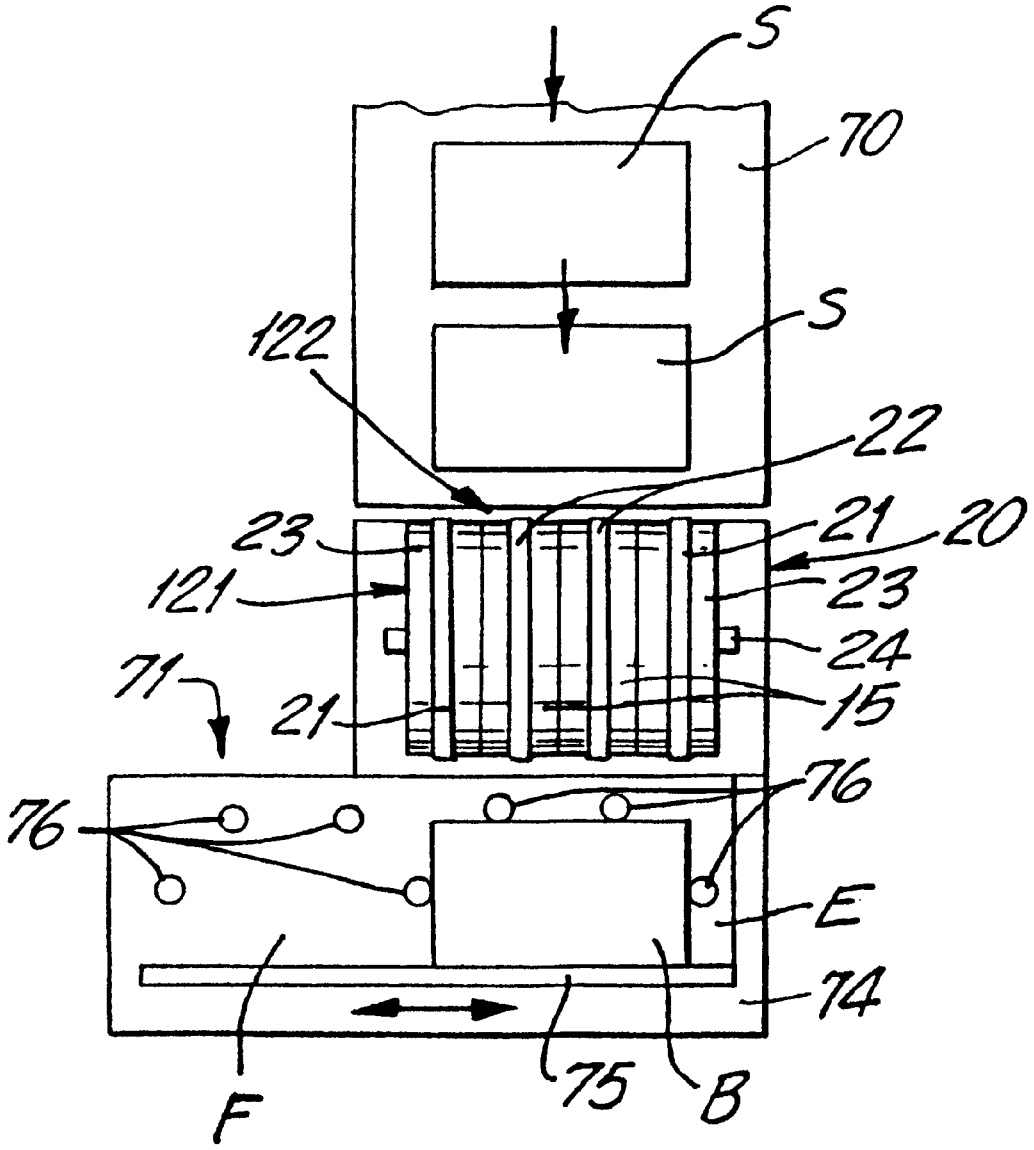
FIG. 9 is a diagrammatic, simplified top view of the embodiment shown in FIG. 9.

Referring to the embodiment of FIGS. 8 and 9 sheets S of paper are fed one-by-one from a horizontal conveyer assembly 70 to a feed assembly 20 which delivers the sheets S into a bin assembly 71 below the level of the conveyor assembly 70. The feed belt assembly 20 may be similar to or the same as the feed belt assembly 20 in the FIGS. 1–3 embodiment and the same reference characters have been used to designate the same structural elements in each. However, the operation of the feed belt assembly 20 is reversed, with the paths of the belt assemblies 121 and 122 reversed so that belts 22 now operate as take-up belts and belts 21 now operate as delivery belts. The sheets S move from the conveyor assembly 70 to the belt 21 and are directed to the stack B on the bin assembly 71 by the guide 77 to which is attached the trigger 73. A feed switch 72 is provided in operative juxtaposition with the belts 21. When the number of sheets in stack B of the bin assembly 71 reach a predetermined level, the trigger 73 will be activated to stop the flow of sheets S. The bin assembly 71 comprises a movable elongated platform 74 on which are side-by-side stacking areas E and F formed by stop 75 and pins 76. The stop 75 and pins 76 may be adjusted to accommodate sheets of different sizes. When the stacking area E is full, the platform 74 is moved transversely (FIG. 8) to present an empty stacking area F to the paper feeding mechanism so that sheets S will be fed to the empty stacking area F while the full stacking bin E is being emptied. This provides continuous feeding of sheets without stopping.

It will thus be seen that the present invention provides an improved paper feeding mechanism which can feed and deliver single sheets quickly into a remote receiving area from a source, such as a vertical or horizontal stack, in order to permit multiple sheet stacking and/or delivery of such sheets at very high speeds, in which the same or similar feed mechanism may be used to feed from different sources as well as the different destinations and which is simple and inexpensive to operate and maintain.

As many varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A sheet feeding mechanism comprising a feed belt assembly, means for feeding sheets to said feed belt assembly, said feed belt assembly comprising a belt, said belt being driven by a first drive roller, an idler roller assembly comprising an idler roller spaced from the drive roller and driven by said first drive roller, a feed switch mechanism, means for pivotally mounting the idler roller assembly for movement toward and away from the feed switch mechanism, whereby the feed switch mechanism will be activated by the idler roller assembly to affect feeding of the sheets.

2. A mechanism as set forth in claim 1 wherein sheets are fed to the feed belt assembly from a source and delivered to an accumulating area and wherein the source is above the level of the accumulating area.

3. A mechanism as set forth in claim 2 wherein the source is a conveyor.

4. A mechanism as set forth in claim 3 wherein the feed belt assembly moves the sheets down into said accumulating area.

5. A mechanism as set forth in claim 4 wherein a bin assembly is provided and is movable transversely of the feed belt assembly and wherein said bin assembly has adjacent bins and is movable transversely of the feed belt assembly when full to present an empty bin to the feed belt assembly.

6. A mechanism as set forth in claim 1 wherein said feed belt assembly comprises a take-up belt assembly and a delivery belt assembly wherein said feeding means move sheets against said take-up belt assembly.

7. A mechanism as set forth in claim 6 wherein said sheets are arranged in a stack, said stack is moved against the take-up belt assembly by the feeding means.

8. A mechanism as set forth in claim 7 wherein said take-up belt assembly comprises a take-up belt against which the stack of sheets are fed, said take-up belt being driven by said first drive roller whereby the take-up belt will remove sheets from the stack one at a time.

9. A mechanism as set forth in claim 8 wherein the idler roller assembly is moved against a rear end of said stack and wherein the take-up belt will apply pressure to the next sheet in the stack as the first sheet is removed from the stack.

10. A mechanism as set forth in claim 9 wherein pressure is applied to the rear end of the stack before the first sheet is removed from the stack whereby the sheets are fed one-by-one in shingle fashion.

11. A mechanism as set forth in claim 10 wherein the stack is horizontally oriented and wherein the pick-up belt assembly is horizontally oriented and lays on top of the stack and wherein means are provided for pushing the stack against the feed belt.

12. A mechanism as set forth in claim 10 wherein said stack is oriented in a vertical direction and a moving means to move the stack against the feed belt assembly.

13. A mechanism as set forth in claim 12 wherein the feed delivery assembly comprises a delivery belt and a delivery drive roller, said delivery belt being driven by said delivery drive roller, a delivery idler roller, said delivery idler roller being driven by said delivery belt, said delivery drive roller being driven by the same drive that drives the first drive roller, said sheets being transferred from the take-up belt to the delivery belt.

14. A mechanism as set forth in claim 13 wherein an accumulating area is provided and wherein said sheets are fed from the delivery belt to said accumulating area.

15. A mechanism as set forth in claim 14 wherein said delivery idler roller assembly comprises an idler roller and a pivoted arm which is spring-pressed toward to the stack.

16. A mechanism as set forth in claim 15 wherein switch means are provided and wherein the idler roller assembly will trip the switch means at a predetermined time to adjust the feeding of the sheets to a feed belt.

17. A mechanism as set forth in claim 16 wherein sheets are fed one-by-one in shingle fashion from the stack to the accumulating area.

18. A mechanism as set forth in claim 17 wherein said accumulating area is below a level of the feed belt.

19. A mechanism as set forth in claim 17 wherein the accumulating area is above a level of the stack.

20. A feed belt assembly for a sheet feeding mechanism comprising a belt assembly comprising a belt, said belt being driven by a first drive roller, an idler roller assembly comprising an idler roller spaced from the drive roller and driven by said first drive roller, a feed switch mechanism for controlling rotation of the drive roller, means for pivotally mounting the idler roller assembly for movement toward and away from the feed switch mechanism, whereby the feed switch mechanism will be activated by the idler roller assembly.

21. A mechanism as set forth in claim 20 wherein said feed belt assembly comprises a take-up belt assembly and a delivery belt assembly.

22. A mechanism as set forth in claim 21 wherein said take-up belt assembly comprises a take-up belt, said take-up belt being driven by said drive roller.

23. A mechanism as set forth in claim 22 wherein the feed belt assembly comprises a delivery belt and a delivery drive roller, said delivery belt being driven by said delivery drive roller, an idler roller, said idler roller being driven by said delivery drive roller being driven by the same drive that drives the first drive roller.

24. A mechanism as set forth in claim 23 wherein said idler roller assembly comprises an idler roller and pivoted arm which is spring-pressed toward to the stack.

25. A mechanism as set forth in claim 24 wherein switch means are provided and wherein the idler roller assembly will trip the switch means at a predetermined time.

* * * * *